US005183454A

United States Patent [19]

Kurosawa et al.

[11] Patent Number: 5,183,454

[45] Date of Patent: Feb. 2, 1993

[54] PAPER CURL CORRECTION APPARATUS

[75] Inventors: Makoto Kurosawa; Masaaki Koseki; Tetsuroh Takahashi; Takeshi Terakado, all of Ibaraki, Japan

[73] Assignee: Hitachi Koki Co., Ltd., Tokyo, Japan

[21] Appl. No.: 863,144

[22] Filed: Apr. 2, 1992

Related U.S. Application Data

[63] Continuation of Ser. No. 609,542, Nov. 6, 1990, abandoned.

[30] Foreign Application Priority Data

Nov. 10, 1989 [JP] Japan ..... 1-293086

[51] Int. Cl.[5] ..... B41F 13/54; B65H 23/34

[52] U.S. Cl. ..... 493/459; 162/271

[58] Field of Search ..... 493/321, 459; 162/197, 162/270, 271

[56] References Cited

U.S. PATENT DOCUMENTS

| | | | |
|---|---|---|---|
| 4,326,915 | 4/1982 | Mutschler | 162/271 |
| 4,539,072 | 9/1985 | Frye et al. | 493/459 |
| 4,952,281 | 8/1990 | Akira | 493/459 |

*Primary Examiner*—William E. Terrell

*Attorney, Agent, or Firm*—Sughrue, Mion, Zinn, Macpeak & Seas

[57] ABSTRACT

In an electrostatic printing machine, a paper curl correction apparatus can vary the amount of curl correction provided by rotating paper guide rollers around a shaft on which paper conveying rollers are provided. As a result, angle between the shaft and a circumference of the paper guide rollers can be varied.

2 Claims, 1 Drawing Sheet

PAPER CURL CORRECTION APPARATUS

This is a continuation of application Ser. No. 609,542, filed Nov. 6, 1990, now abandoned.

BACKGROUND OF THE INVENTION

The present invention relates to a paper curl correction apparatus, and particularly to a paper curl correction apparatus for correcting curl of paper used in an electrostatic recording printing machine.

An important point in printing with an electrostatic recording system is close adherence between printing paper and a photosensitive body on which toner adheres to form a latent image. Proposed methods of transferring toner onto paper have included a corotron system using static electricity, a method of using belts or rollers and similarly using static electricity to press paper against a photosensitive body, and so on.

However, the latter method requires pressing apparatus and apparatus for cleaning residual toner after transfer. Therefore, the equipment using this method is expensive.

On the other hand, in the case of the former method, close adhesive force between a photosensitive body and printing paper depends on only electrostatic force. In the case where paper curls in a direction opposite to the curvature of the photosensitive body, the close adherence of the paper against the photosensitive body is so poor that toner cannot be transferred well. That is, a transfer failure or toner omission often occurs. Much toner is omitted, particularly at front and rear end portions of the paper with respect to the paper advancing direction.

The curl of paper to be subjected to printing may be caused not only by changes in environmental temperature and humidity but also by thermal influence after toner transfer before a fixing process. That is, because of thermal influence after toner transfer, paper becomes unable to keep its moisture equilibrium, so that the paper curls. Conventionally, to prevent transfer failure because of poor close adherence between a photosensitive body and paper because of curl of the paper and further because of imperfect toner fixing, sheets of paper which hardly curl have been used. Alternatively, a limit has been set in a printing range of paper so that, specifically, printing is not performed in the vicinity of front and rear end portions of the paper with respect to the paper advancing direction.

According to the former countermeasure, however, the kind of paper to be subject to printing is limited. As a result, the countermeasure does not afford wide use of the equipment. According to the latter countermeasure, on the other hand, printing cannot be performed effectively on the surface portion of paper, so that not only is there uneconomical consumption of paper per unit quantity of printing, but also, when paper curls on the way of conveyance, a floating paper edge of the curled paper is apt to be caught by any of a number of parts for conveying paper, so that stable paper running often is disturbed.

SUMMARY OF THE INVENTION

In view of the foregoing, it is an object of the present invention to provide a paper curl correction apparatus that is superior in any point of reliability and economical property of the equipment, in which all curls generated on paper can be properly corrected regardless of the kind of paper to be used in the electrostatic recording printing machine. As a result, it is possible to remove limitations on the kind of paper to be subject to printing and on wide use of the equipment. Also, it is possible to perform printing effectively on a surface portion of paper, thereby avoiding uneconomical consumption of paper per unit printing quantity. Further, difficulty in paper running can be prevented from occurring.

In order to attain the above object, according to one aspect of the present invention, a paper curl correction apparatus provided along a paper conveying path in an electrostatic recording printing machine includes a plurality of paper conveying rollers, a lower paper curl correction shaft provided so as to be biased against the paper conveying rollers with reference to a paper advancing direction, and paper guide rollers provided in front of the paper conveying rollers and the paper curl correction shaft with reference to the paper advancing direction.

Preferably, the paper curl correction apparatus according to the present invention further includes apparatus for making variable a position at which the paper guide rollers are fixed, so that an angular range over which paper is wound around the paper curl correction shaft can be adjusted.

Thus, according to the present invention, along the paper conveying path in the electrostatic recording printing machine, curled paper fed by the paper guide rollers between the paper conveying rollers and the lower paper curl correction shaft is wound around the paper curl correction shaft which is provided so as to be biased to the side of the paper conveying rollers with respect to the paper advancing direction. As a result, the paper is transformed plastically in a direction opposite to the curl direction, and the curl is corrected.

DETAILED DESCRIPTION OF THE PREFERRED EMBODIMENT

Figure 1:
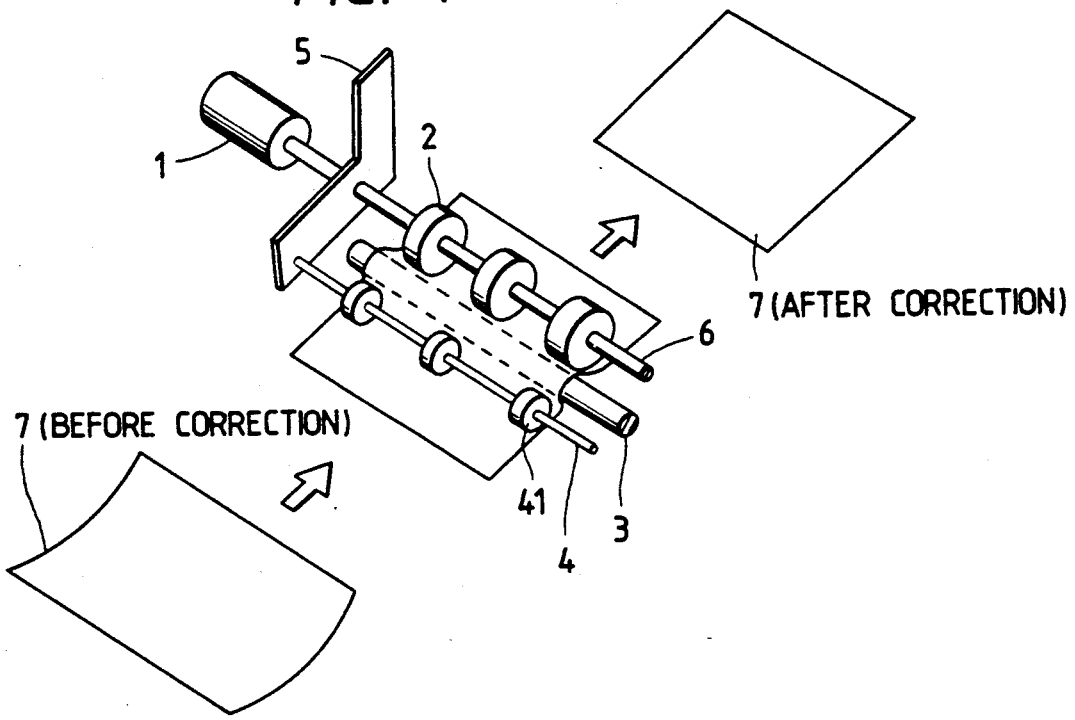
FIG. 1 is a perspective view showing an embodiment of the paper curl correction apparatus according to the present invention.

Referring to the drawings, an embodiment of the present invention now will be described.

Figure 2:
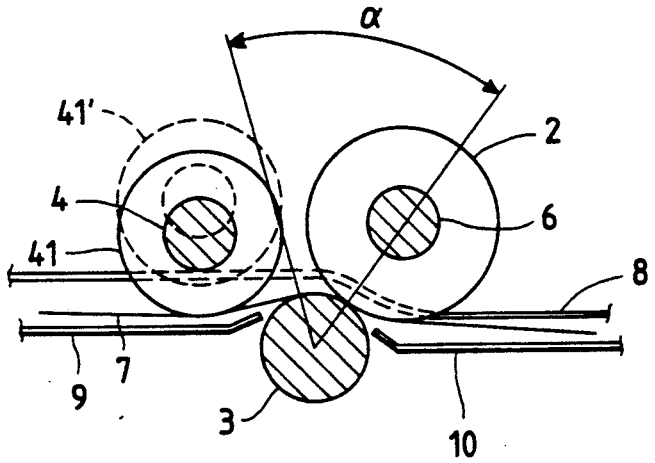
FIG. 2 is an enlarged vertical section showing a part of the paper curl correction apparatus shown in FIG. 1.

In FIG. 1, an electric motor 1 is arranged to drive rotationally paper conveying rollers 2 supported by a frame (not shown). A paper curl correction shaft 3 also is supported by the frame, and is pressed against the paper conveying rollers 2 so as to rotate as the paper conveying rollers 2 rotate. A roller shaft 4 is supported by a pair of arms 5 (only one arm being shown in the drawing). Paper guide rollers 41 are rotated freely about the shaft 4. The arms 5 are arranged to be pivotable about a shaft 6 of the paper conveying rollers 2. As shown in FIG. 2, for example, when the arms 5 are pivoted clockwise, the paper guide rollers 41 are moved to the position 41' shown by a dotted line in the drawing. As shown in FIG. 2, paper 7 is guided by paper guides 8 and 9 so as to enter the paper curl correction apparatus according to the present invention (in the direction shown by an arrow in FIG. 1). The paper 7 is guided between the paper guide 8 and a paper guide 10 in the state where the paper 7 is sandwiched between the paper conveying rollers 2 and the paper curl correction shaft 3. Then, the paper 7 is sent to the next step in the printing apparatus.

Thus, as shown in FIG. 2, the paper 7 is conveyed while being wound around the paper curl correction shaft 3 within an angular range or a sector range between a circumference of the paper guide rollers 41 on the side of the roller 2, and the center of each of the paper conveying rollers 2. As a result, the curl of the paper is corrected, so that, for example, in a transfer process omitted in the drawing, a defect such as a transfer failure or the like is eliminated. Further, there has been a problem that, while paper 7 is being conveyed, a floating edge of the paper 7 is apt to be caught by any of a number of parts provided for conveying the paper, so that stable running of the paper is often disturbed. According to the present invention, however, such a defect can be prevented from occurring.

As described above, the arms 5 are arranged so as to be rotatable about the shaft 6 of the paper conveying rollers 2. As shown in FIG. 2, for example, when the arms 5 are rotated clockwise, the paper guide rollers 41 are moved to the position 41' shown by the dotted line in the drawing, so that the paper winding angular range is made small. This means that curl can be corrected suitably by determining the position of the paper guide rollers 41 in accordance with the amount of paper curl, that is, by selecting a suitable position of the arms 5. In an experiment, in the case where paper having a basic weight of 180 kg was curled by 20 mm and a paper curl correction shaft 3 having a diameter of 16 mm was used, the curl of the paper 7 was corrected completely under the condition that the paper winding angle was selected to be 30 degrees. Further, in the case where paper having a basic weight of 55 kg was curled by 10 mm, a 15 degree paper winding angle was sufficient.

In short, according to the present invention, the paper curl correction apparatus provided along a paper conveying path in an electrostatic recording printing machine includes the paper conveying rollers 2, a lower paper curl correction shaft 3 provided so as to be biased against the paper conveying rollers with reference to the paper advancing direction, and paper guide rollers 41 provided in front of the paper conveying rollers 2 and the paper curl correction shaft 3 with reference to the paper advancing direction. With the above-described configuration, along a paper conveying path in the electrostatic recording printing machine, the curled paper 7 fed by the paper guide rollers 41 between the paper conveying rollers 2 and the lower paper-curl correction shaft 3 is wound around the paper curl correction shaft 3 which is provided so as to be biased on the side of the paper conveying rollers 2 in reference to the paper advancing direction. At this time, the paper 7 is transformed plastically in a direction opposite to the direction of curl, so that the curl is corrected properly.

As will be clearly understood from the description with respect to the illustrated embodiment of the present invention, therefore, it is possible to provide a paper curl correction apparatus in which all curls generated on paper can be corrected properly, regardless of the kind of paper to be used in the electrostatic recording printing machine. Thus, the paper curl correction apparatus according to the present invention is superior in any point of reliability and economical property of the equipment.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. A paper curl correction apparatus provided along a paper conveying path in an electrostatic recording printing machine for correcting the curl in discrete paper sheets, said apparatus comprising:

a plurality of paper conveying rollers arranged on a shaft for conveying a discrete paper sheet along a path in a paper advancing direction;

a lower paper curl correction shaft;

means for biasing said paper curl correction shaft against said paper conveying rollers in a direction having a substantial component in the paper advancing direction;

a plurality of paper guide rollers arranged on a shaft and provided upstream of and spaced from said plurality of paper conveying rollers and said paper curl correction shaft with reference to the paper advancing direction, said plurality of paper guide rollers causing the paper sheet path to extend about an angular portion of the circumference of said paper curl correction shaft; and a position varying mechanism for varying a position at which said paper guide rollers are fixed so as to vary the angular range over which said paper sheet extends about the circumference of said paper curl correction shaft and to adjust a degree of correction of paper curl.

2. A paper curl correction apparatus according to claim 1, wherein said position varying mechanism comprises an arm on which said paper conveying rollers and said paper guide rollers are provided, said arm being rotatable so as to vary said angular range.

* * * * *